United States Patent [19]

Marchesano

[11] 4,220,099

[45] Sep. 2, 1980

[54] PALLET

[76] Inventor: Anthony J. Marchesano, 15 Oak St., Lincroft, N.J. 07738

[21] Appl. No.: 710,558

[22] Filed: Jul. 30, 1976

[51] Int. Cl.[3] ..... B65D 19/26

[52] U.S. Cl. ..... 108/51.1; 52/593; 52/666; 108/57.1

[58] Field of Search ..... 108/51.1–57.1; 217/43 A; 52/592, 593, 666, 668, 669, 753 T

[56] References Cited

U.S. PATENT DOCUMENTS

| | | | |
|---|---|---|---|
| 316,175 | 4/1885 | Putney | 52/753 T |
| 1,928,547 | 9/1933 | Strong | 52/593 X |
| 2,468,026 | 4/1949 | Boone | 108/57.1 |
| 2,497,737 | 2/1950 | Norrefeldt et al. | 108/57.1 X |
| 2,649,626 | 8/1953 | Henrichsen | 52/593 X |
| 3,058,709 | 10/1962 | Van Moss, Jr. et al. | 108/51.1 |
| 3,192,883 | 7/1965 | Massengale | 108/56.1 |
| 3,212,462 | 10/1965 | Pasquier | 108/57.1 X |
| 3,261,897 | 7/1966 | Munk | 52/753 T X |
| 3,466,821 | 9/1969 | O'Shaughnessy et al. | 52/593 X |
| 3,878,796 | 4/1975 | Morrison | 108/56.1 |

FOREIGN PATENT DOCUMENTS

| | | | |
|---|---|---|---|
| 699130 | 10/1953 | United Kingdom | 108/51.1 |

*Primary Examiner*—William E. Lyddane
*Attorney, Agent, or Firm*—Samuelson & Jacob

[57] ABSTRACT

A pallet for supporting product capable of being moved by means of a fork lift truck or similar unit having at least two runners and a plurality of deck boards or stringers, the deck boards being dadoed into the runners, at least a portion of the inner edge of each of the outermost deck boards being thinner than the full thickness of the deck board, the corresponding runner adjacent the thinner portion of the deck board being undercut complementary thereto to receive the deck board in intimate contact to thereby strengthen the pallet.

6 Claims, 12 Drawing Figures

PALLET

The invention relates to pallets which are handled by fork lift trucks, hand trucks and similar devices for moving them in warehouses, on loading platforms and in storage locations of all types.

In particular, the invention is directed toward providing pallets which are less susceptible to fracture from the continued entry of the forks into the pallet. Various techniques and constructions for strengthening the two outermost deck boards have been used and suggested. Most of these prior art devices have utilized extra reinforcement or relatively expensive construction in order to attain the desired result.

Accordingly, it is an important object of the invention to provide a pallet which is stronger than the ordinary prior art pallets and is economical to produce.

It is a further object of the invention to provide a pallet wherein the inner edges of the outermost deck boards are tapered along at least a portion of their length and are engaged in undercut portions of the runners.

It is another object of the invention to provide a pallet wherein the runners are dadoed and the deck boards fit in the dadoes to thereby form a flat top. Such a pallet is stronger than the ordinary, prior art pallets in which the deck boards overlay the runners and the deck boards are pulled loose under constant use.

These and other objects, advantages, features and uses will be apparent during the following discussion when taken together with the drawing.

Broadly, the invention contemplates a pallet having a flat top formed by inserting the deck boards in dadoes in the runners and nailing or otherwise affixing the deck boards to the runners. At least a portion of the inner edge of the outermost deck boards is tapered to be thinner than the full thickness of the deck boards. The runner adjacent to the thinned portion is undercut complementary to the thinned portion to attain intimate contact between the deck board and the runner. The runners and deck boards are cut so that the intimate contact is maintained even after the boards shrink.

In the accompanying drawing, forming a part of this application, in which like numerals are employed to designate like parts throughout the same:

Figure 1:
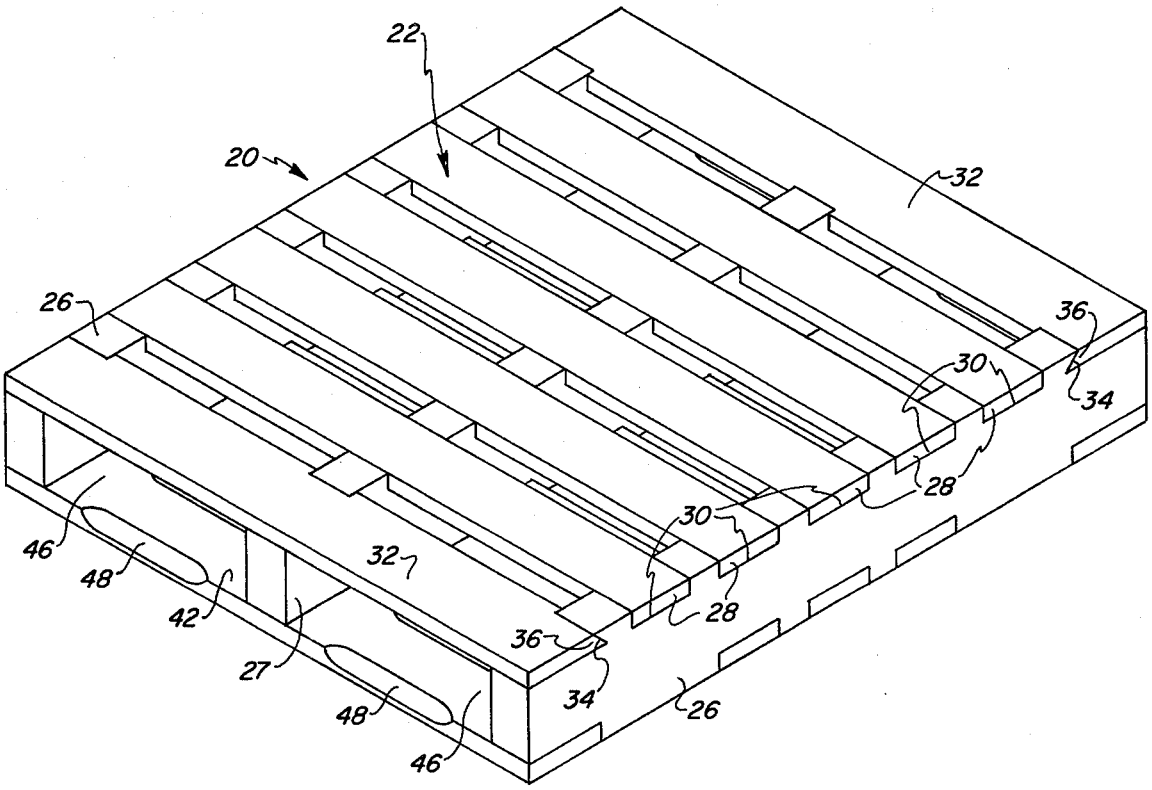
FIG. 1 is an isometric drawing, viewed from the top, of an embodiment of a pallet of the invention of the nonreversible type wherein the top deck carries the load and the bottom deck presents a stable support.
Figure 2:
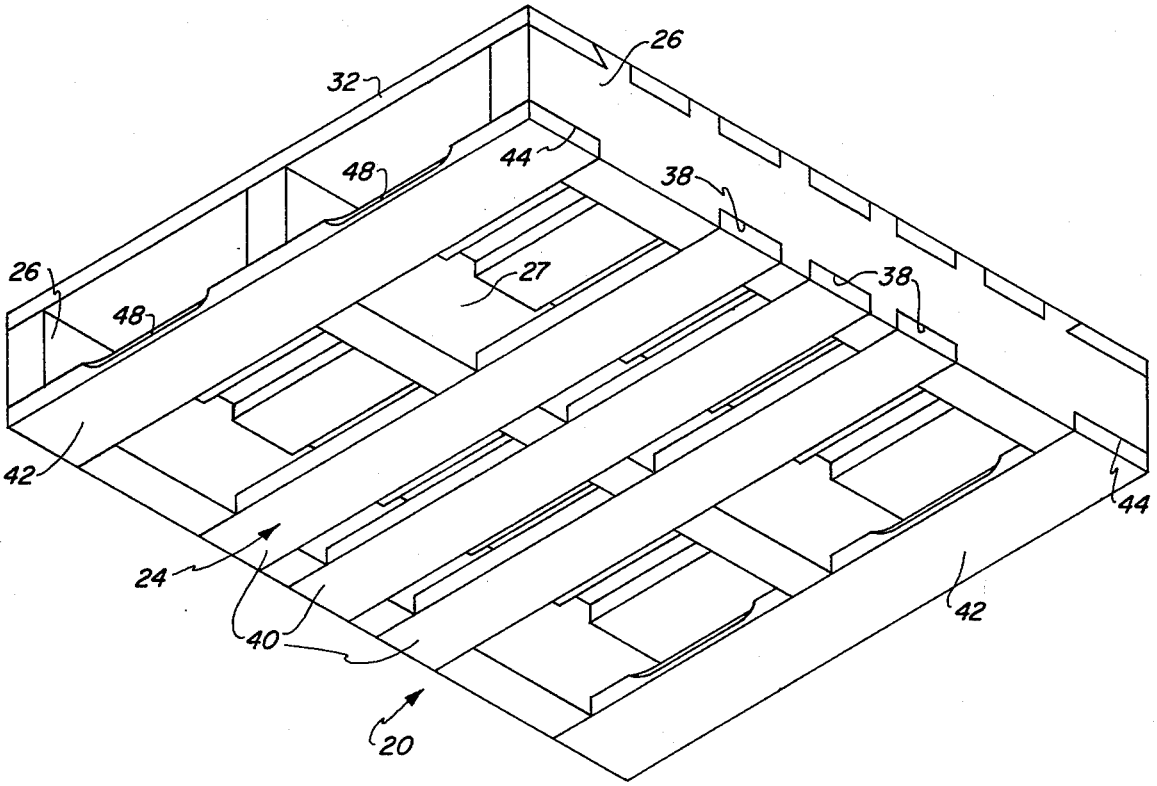
FIG. 2 is an isometric drawing of the pallet of FIG. 1, viewed from the bottom, to show the bottom construction.

In the drawing, wherein, for the purpose of illustration, are shown various embodiments of the invention, the numeral 20 designates an embodiment of the invention, generally. Pallet 20 (FIGS. 1 and 2) is seen to comprise a flat upper deck 22 on which the product is placed and a lower deck 24 which is also flat. Pallet 20 is provided with two outer runners 26 and a plurality of top deck boards 28 which are fitted into a plurality of dadoes 30.

Each outermost deck board 32 is formed so that at least a portion of its inner edge is thinner than the balance of the deck board 32 as shown at 36. The runners 26 are undercut as shown at 34 in order to obtain good intimate contact between the runner and the associated deck board. The undercutting of the runners and the tapering of the deck board edge gives added strength to the top deck since the two elements shrink, upon drying, in the same direction to thereby maintain a tight fit. For additional load bearing capacity, pallets of the invention may be provided with one or more intermediate runners 27 which are similarly dadoed to receive the deck boards. The deck boards are held in place with respect to the runners by nails or similar fastening means.

Pallet 20 is constructed with a flat bottom deck in which the runners 26 are dadoed as shown at 38 to receive deck boards 40. Outer deck boards 42 are engaged in recessed portions 44 in runners 26. Where a runner 27 is used in a pallet 20, it, too, is provided with dadoes and recesses to receive the deck boards 40 and 42. The flat bottom 24 of pallet 20 is quite stable because of the fact that its load bearing surface is maximized over the greatest possible area.

Pallet 20 is of the type commonly referred to as "two way entry". Forks from a fork lift truck enter openings 46 (one set at each end of the pellet) and the fork lift truck is then operated in the usual manner. When the so-called "hand jacks" are used, the wheels of the unit are moved past deck board 42 by means of ramps 48 which are cut in deck board 42.

Figure 3:
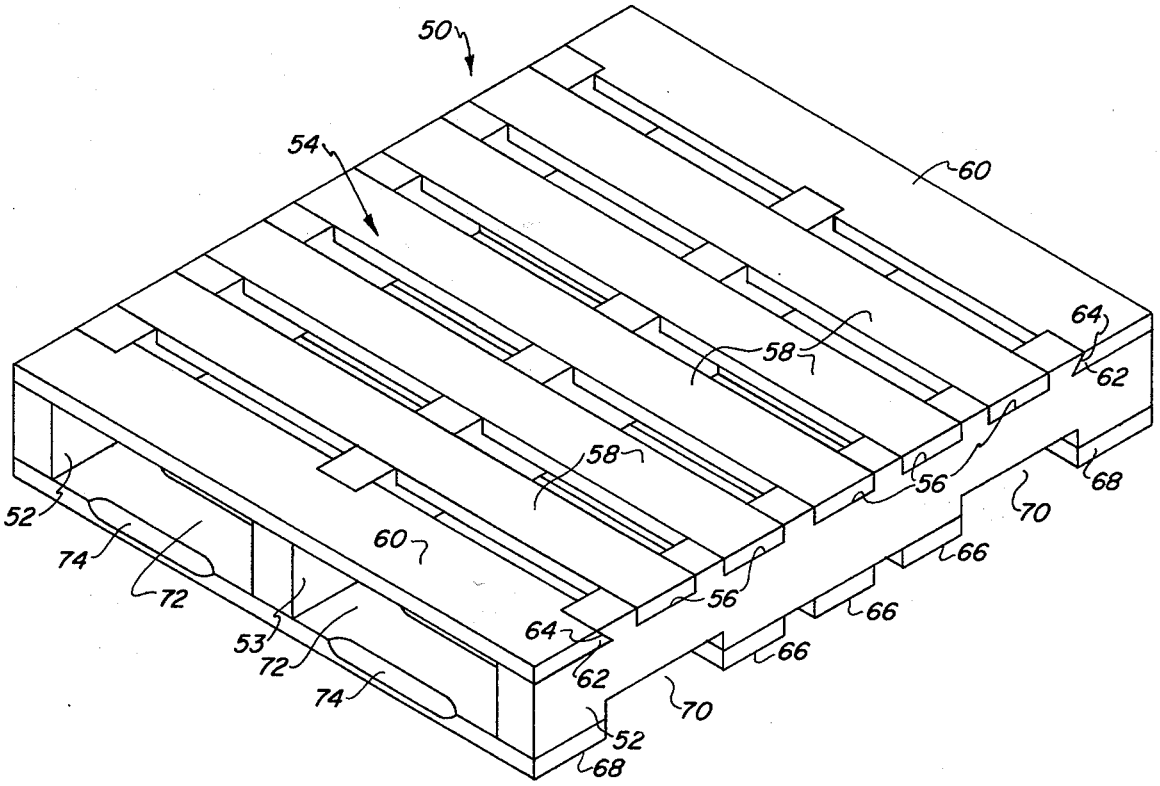
FIG. 3 is a view, similar to that of FIG. 1, of a four way entry pallet of the invention.
Figure 4:
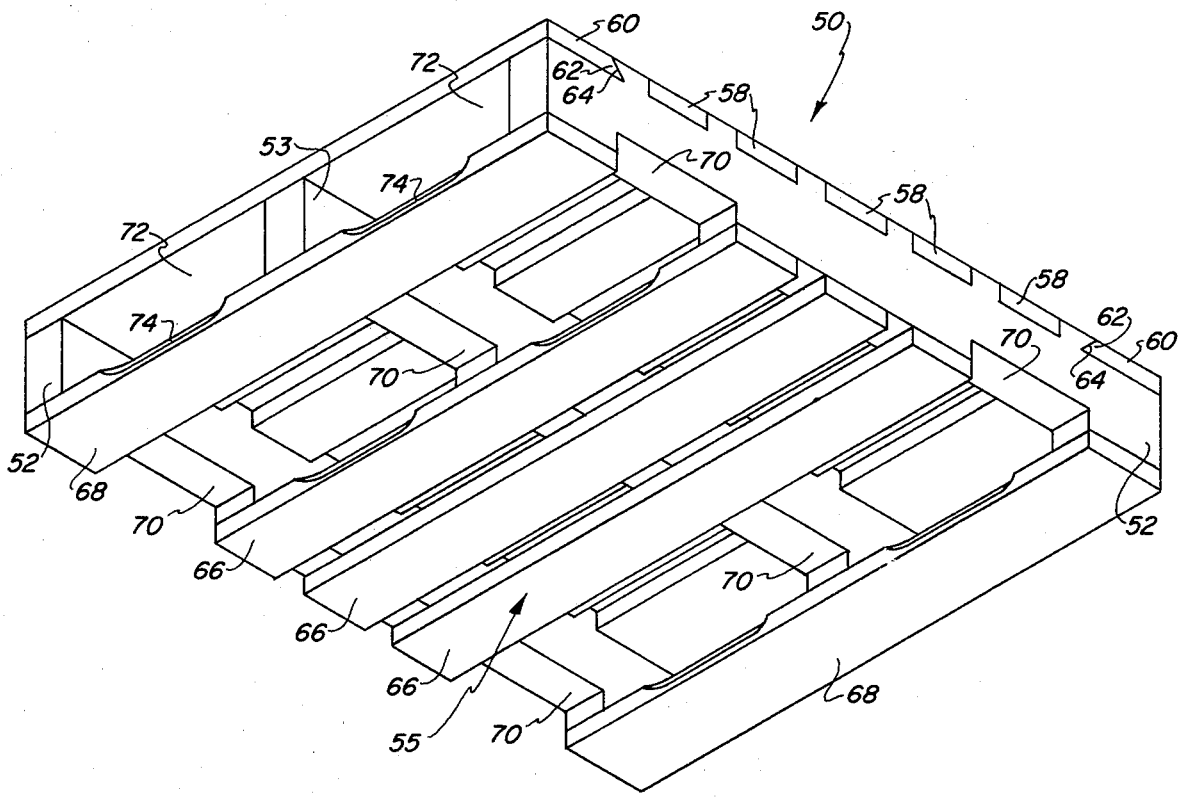
FIG. 4 is a view, similar to that of FIG. 2, of the pallet of FIG. 3.
Figure 5:
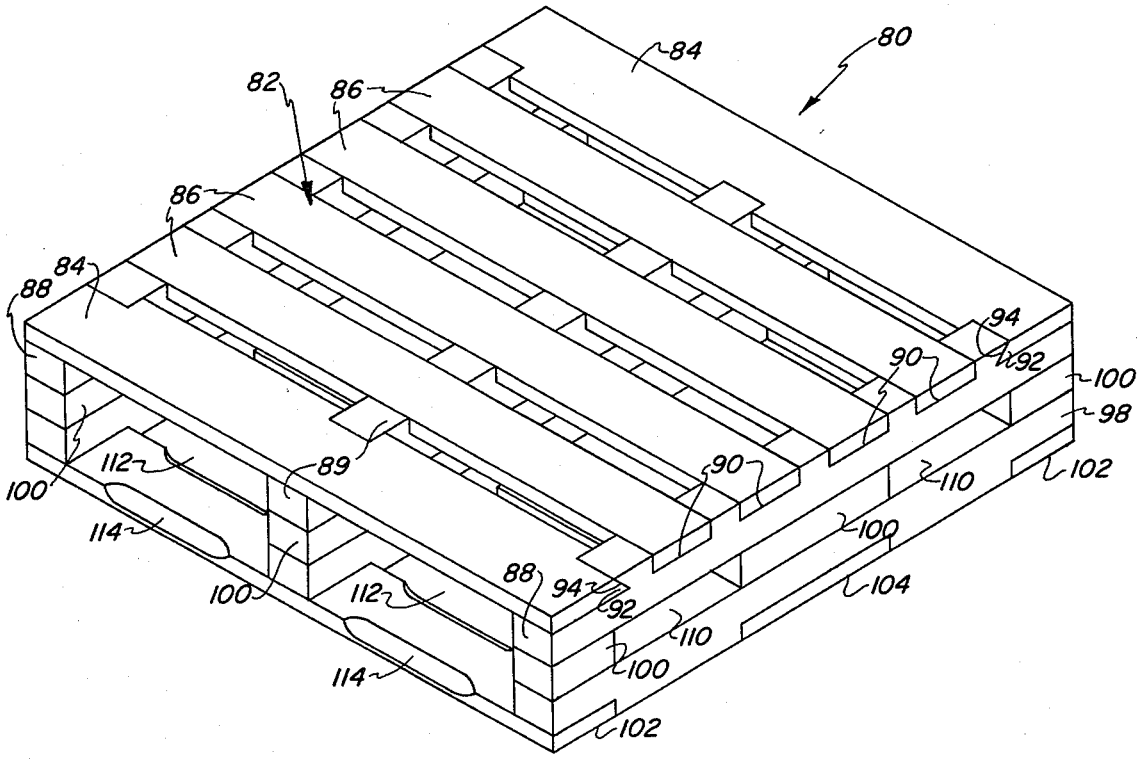
FIG. 5 is a view, similar to that of FIG. 1, of a four way entry pallet of the block type with a flush bottom deck.
Figure 6:
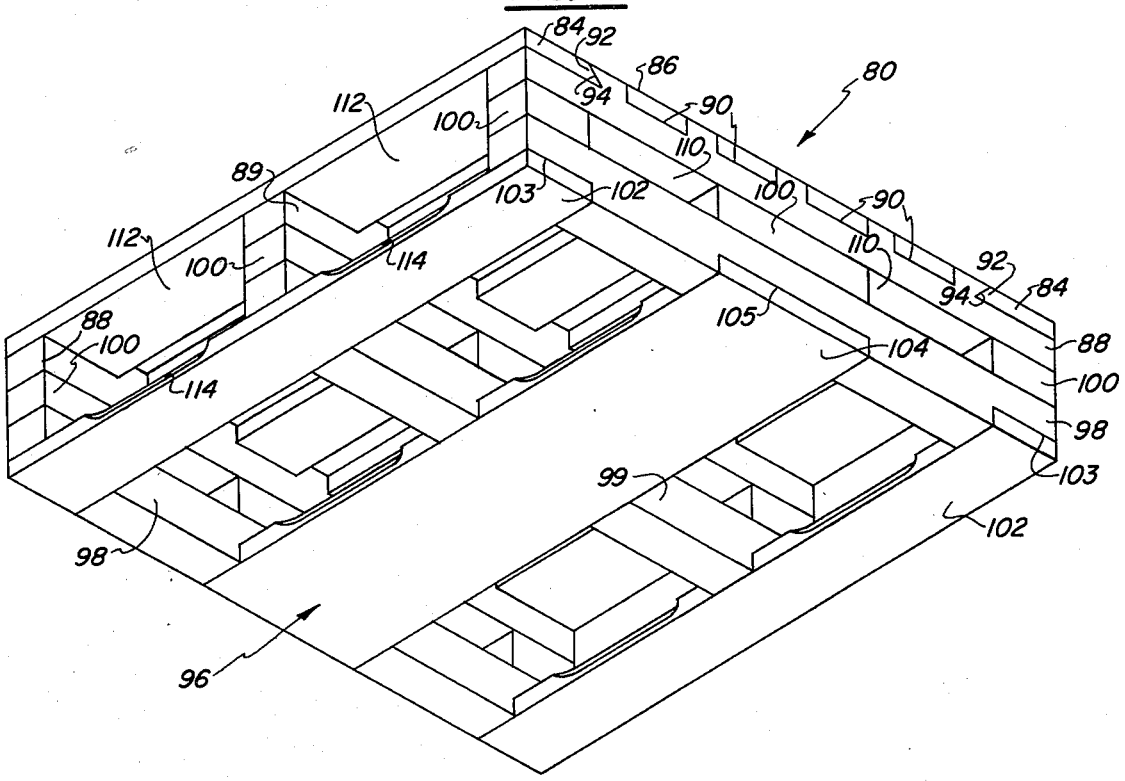
FIG. 6 is a view, similar to that of FIG. 2, of the pallet of FIG. 5.

Pallet 50 (FIGS. 3 and 4) is of the "four way entry" type. In this type of pallet, the forks of a fork lift truck may engage openings in all four sides of the pallet. Pallet 50 is provided with a pair of outer runners 52 and an intermediate runner 53, if required. The top 54 of pallet 50 is made flat by dadoing the runners as shown at 56 and fastening the deck boards 58 in the dadoes 56. Outer deck boards 60 have portions of their inner edges made thinner than the balance of the deck board 60 as shown at 62 and the runners 52 are undercut as shown at 64. The flat top 54 of pallet 50 is identical in structural concept to top 22 of pallet 20.

Lower deck 55 is formed by nailing or otherwise affixing outer deck boards 68 and intermediate deck boards 66 to the lower edges of runners 52 and 53. The spaces on runners 52 and 53 between each outer deck board 68 and the adjacent deck board 66 is recessed as shown at 70. These recesses are provided to permit the forks of a fork lift truck to be inserted therein to lift the pallet.

Openings 72 are provided for the forks of a fork lift truck and ramps 74 are provided on deck board 68 to accommodate a hand jack in the same manner as has been previously described in connection with pallet 20.

Pallet 80 is of the four entry type with a flat top deck 82 and a flat bottom deck 96. The upper deck 82 is formed of outer deck boards 84 and interior deck boards 86. Outer runners 88 and intermediate runner 89 are dadoed as shown at 90 to receive the deck boards which are then nailed or otherwise held in place. The inner edges of outer deck boards 84 are tapered as shown at 92 and the runners are undercut to receive the tapered edges as shown at 94. Thus, the flat top deck 82 is formed.

A pair of lower outer runners 98 and an intermediate outer runner 99 are recessed as shown at 103 to receive outer lower deck boards 102 and dadoes 105 receive an intermediate lower deck board 104. If desired, more than one intermediate deck board may be used. The deck boards 102 and 104 are nailed or otherwise fixed in place to form a flat bottom deck.

In order to provide entry openings 110 in the sides of pallet 80, the runners 88 and 98 and 89 and 99 are spaced apart by means of blocks 100. These openings 110 will readily receive the forks of a fork lift truck. Openings 112 will receive the forks of a fork lift truck or the wheels of a hand jack which will enter the interior of the pallet by means of ramps 114.

Figure 7:
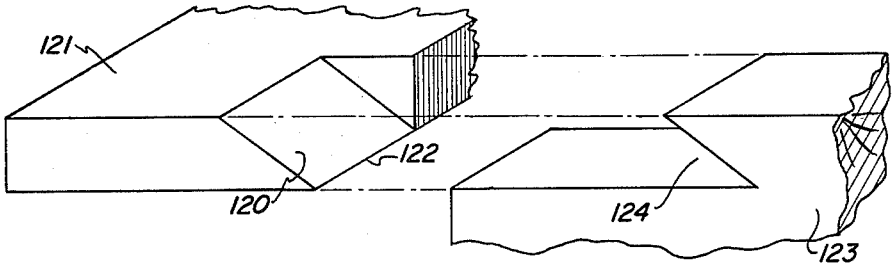
FIGS. 7–11 are enlarged fragmentary isometric views showing various constructions for the inner edge of an outermost deck board and the complementary cuts in the mating runners.

In all of the embodiments shown and described heretofore, the inner edges of the outer deck boards have been made thinner by a taper such as is shown in detail in FIG. 7. The taper 120 in deck board 121 terminates in a line 122 and the runner 123 is undercut as shown at 124 so that the two mating portions are complementary.

Figure 8:
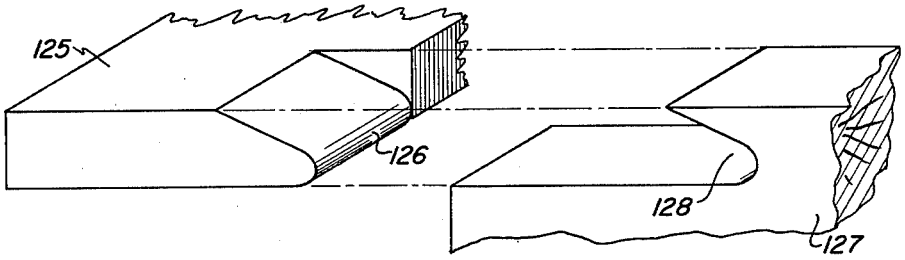

Alternatively, the tapered portion of the deck board 125 may terminate in a curved surface, as shown at 126, which matches a complementary curved surface on the runner 127, as shown at 128 (FIG. 8).

Figure 9:
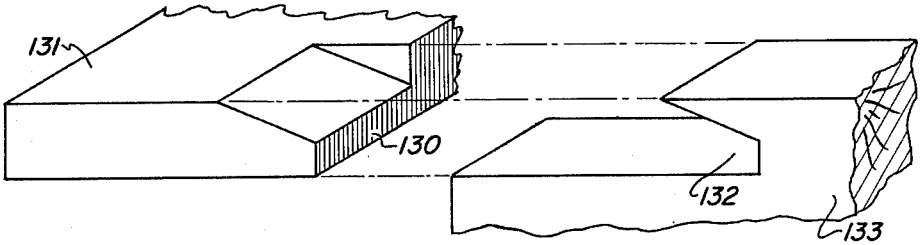

In FIG. 9, the tapered edge of deck board 131 is seen to terminate in a bull nose, as shown at 130 and the runner 133 is cut in a complementary shape, as shown at 132.

Figure 10:
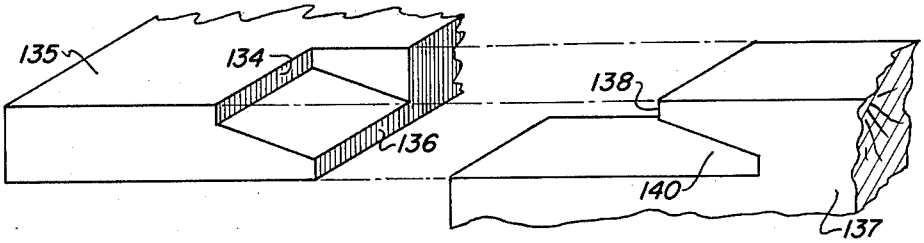

In FIG. 10, the tapered edge of deck board 135 starts below the top edge of the deck board leaving a ledge 134 and terminating in a bull nose 136. The runner 137 is cut in complementary fashion having a ledge 138 and a matching undercut 140 to receive the bull nose 136. It is apparent to one skilled in the art that the ledges of FIG. 10 may be used with the embodiments of FIGS. 7 and 8.

Figure 11:
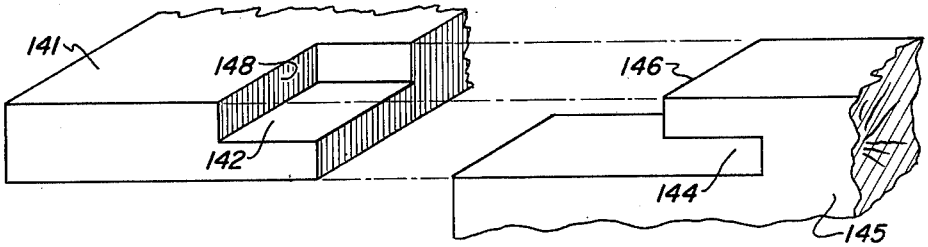

In FIG. 11 there is shown a still further mating construction commonly referred to as a ship lap. The deck board 141 is cut with a rabbet 142 which engages in recess 144 of runner 145. The overlapping edge 146 on the runner is in contact with the vertical wall 148 of the rabbet.

Figure 12:
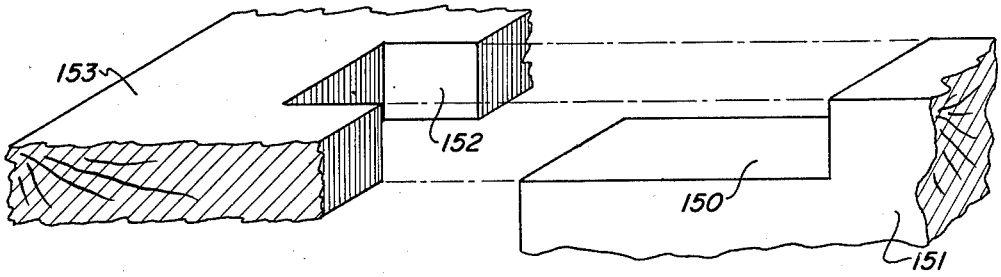
FIG. 12 is a view, similar to FIGS. 7–11, of a construction used with intermediate runners.

In FIG. 12, there is shown a simple joint which may be used on intermediate runners for added shock absorbing qualities. A rabbet 150 is cut in the runner 151 and a recess 152 is cut in the deck board 153 to engage the runner. It is apparent that the constructions of FIGS. 7–11 may also be used for the intermediate runners. Pallets of the invention may also be constructed with a simple butt joint between the intermediate runner and the outermost deck board.

It should be understood that any of the tapered sections of FIGS. 7–10 or the rabbet of FIG. 11 may be cut along the full length or any part of the length of the deck board so long as the cut sections are at least of sufficient length to engage the complementary cuts in the runners. Moreover, any of the joining constructions shown in FIGS. 7–12 may be used with any of the pallets illustrated in FIGS. 1–6.

While particular embodiments of the invention have been shown and described, it is apparent to those skilled in the art that modifications are possible without departing from the spirit of the invention or the scope of the subjoined claims.

The embodiments of the invention in which an exclusive property or privilege is claimed are defined as follows:

1. A pallet comprising:

a pair of spaced apart runners, each runner having upper and lower edges and opposite ends;

at least the upper edge of each of the runners having a plurality of dadoes therein, each of the dadoes in one of the runners being opposite a dado in the other of the runners;

a plurality of deck boards stretching between the runners, each deck board having a top surface and a bottom surface;

each of the plurality of deck boards engaging a dado in each runner such that the top surfaces of the deck boards and the corresponding upper edges of the runners are at the same level to form the top of the pallet;

the plurality of deck boards including an outermost deck board at each of two opposite ends of the runners, the outermost edge of each outermost deck board being essentially flush with the corresponding ends of the runners so that the ends of the runners do not project beyond the top of the pallet;

at least a portion of the innermost edge of each of the two outermost deck boards being thinner than the full thickness of said deck boards;

the runner adjacent to said thinner portion being undercut beneath the upper edge of the runner complementary to the thinner portion to receive the deck board in intimate contact therewith;

the thinner portion of each deck board having a configuration which drops off from the top surface toward the bottom surface of the deck board in the direction extending away from the outermost edge and toward the innermost edge such that the upper edge of the corresponding runner overlaps essentially the entire thinner portion so as to hold down the corresponding innermost edge against shrinkage and against impact forces upon the outermost edge of the outermost deck board in said direction;

the thinner portion of the deck board being a rabbet and the runner having a recess therein to receive said rabbet;

a second pair of spaced apart runners;

a plurality of spacers affixed to a runner of each pair of the spaced apart runners to leave at least two openings between the said runners;

the outermost edge of each of the second pair of runners having a second plurality of dadoes therein, each of said dadoes in one of said runners being opposite one of said dadoes in the other of said runners; and a second plurality of deck boards stretching between the second pair of runners;

each of the second plurality of deck boards engaging a dado in each of the second pair of runners such that the second plurality of deck boards and the second pair of runners are at the same level to form the bottom of the pallet.

2. A pallet comprising:

a pair of spaced apart runners, each runner having upper and lower edges and opposite ends;

at least the upper edge of each of the runners having a plurality of dadoes therein, each of the dadoes in one of the runners being opposite a dado in the other of the runners;

a plurality of deck boards strecthing between the runners, each deck board having a top surface and a bottom surface;

each of the plurality of deck boards engaging a dado in each runner such that the top surfaces of the deck boards and the corresponding upper edges of the runners are at the same level to form the top of the pallet;

the plurality of deck boards including an outermost deck board at each of two opposite ends of the runners, the outermost edge of each outermost deck board being essentially flush with the corresponding ends of the runners so that the ends of the runners do not project beyond the top of the pallet;

at least a portion of the innermost edge of each of the two outermost deck boards being thinner than the full thickness of said deck boards;

the runner adjacent to said thinner portion being undercut beneath the upper edge of the runner complementary to the thinner portion to receive the deck board in intimate contact therewith;

the thinner portion of each deck board having a configuration which drops off from the top surface toward the bottom surface of the deck board in the direction extending away from the outermost edge and toward the innermost edge such that the upper edge of the corresponding runner overlaps essentially the entire thinner portion so as to hold down the corrsponding innermost edge against shrinkage and against impact forces upon the outermost edge of the outermost deck board in said direction;

the thinner portion of the deck board being a tapered chamfer;

the tapered chamfer terminating in a curved surface;

a second pair of spaced apart runners;

a plurality of spacers affixed to a runner of each pair of the spaced apart runners to leave at least two openings between the said runners;

the outermost edge of each of the second pair of runners having a second plurality of dadoes therein, each of said dadoes in one of said runners being opposite one of said dadoes in the other of said runners; and a second plurality of deck boards stretching between the second pair of runners;

each of the second plurality of deck boards engaging a dado in each of the second pair of runners such that the second plurality of deck boards and the second pair of runners are at the same level to form the bottom of the pallet.

3. A pallet comprising:

a pair of spaced apart runners, each runner having upper and lower edges and opposite ends;

at least the upper edge of each of the runners having a plurality of dadoes therein, each of the dadoes in one of the runners being opposite a dado in the other of the runners;

a plurality of deck boards stretching between the runners, each deck board having a top surface and a bottom surface;

each of the plurality of deck boards engaging a dado in each runner such that the top surfaces of the deck boards and the corresponding upper edges of the runners are at the same level to form the top of the pallet;

the plurality of deck boards including an outermost deck board at each of two opposite ends of the runners, the outermost edge of each outermost deck board being essentially flush with the corresponding ends of the runners so that the ends of the runners do not project beyond the top of the pallet;

at least a portion of the innermost edge of each of the two outermost deck boards being thinner than the full thickness of said deck boards;

the runner adjacent to said thinner portion being undercut beneath the upper edge of the runner complementary to the thinner portion to receive the deck board in intimate contact therewith;

the thinner portion of each deck board having a configuration which drops off from the top surface toward the bottom surface of the deck board in the direction extending away from the outermost edge and toward the innermost edge such that the upper edge of the corresponding runner overlaps essentially the entire thinner portion so as to hold down the corresponding innermost edge against shrinkage and against impact forces upon the outermost edge of the outermost deck board in said direction;

the thinner portion of the deck board being a tapered chamfer;

the tapered chamber terminating in a flat surface such as bull nose;

a second pair of spaced apart runners;

a plurality of spacers affixed to a runner of each pair of the spaced apart runners to leave at least two openings between the said runners;

the outermost edge of each of the second pair of runners having a second plurality of dadoes therein, each of said dadoes in one of said runners being opposite one of said dadoes in the other of said runners; and a second plurality of deck boards stretching between the second pair of runners;

each of the second plurality of deck boards engaging a dado in each of the second pair of runners such that the second plurality of deck boards and the second pair of runners are at the same level to form the bottom of the pallet.

4. A pallet comprising:

a pair of spaced apart runners, each runner having upper and lower edges and opposite ends;

at least the upper edge of each of the runners having a plurality of dadoes therein, each of the dadoes in one of the runners being opposite a dado in the other of the runners;

a plurality of deck boards streching between the runners, each deck board having a top surface and a bottom surface;

each of the plurality of deck boards engaging a dado in each runner such that the top surfaces of the deck boards and the corresponding upper edges of the runners are at the same level to form the top of the pallet;

the plurality of deck boards including an outermost deck board at each of two opposite ends of the runners, the outermost edge of each outermost deck board being essentially flush with the corresponding ends of the runners so that the ends of the runners do not project beyond the top of the pallet;

at least a portion of the innermost edge of each of the two outermost deck boards being thinner than the full thickness of said deck boards;

the runner adjacent to said thinner portion being undercut beneath the upper edge of the runner complementary to the thinner portion to receive the deck board in intimate contact therewith;

the thinner portion of each deck board having a configuration which drops off from the top surface toward the bottom surface of the deck board in the direction extending away from the outermost edge and toward the innermost edge such that the upper edge of the corresponding runner overlaps essentially the entire thinner portion so as to hold down the corresponding innermost edge against shrinkage and against impact forces upon the outermost edge of the outermost deck board in said direction;

the thinner portion of the deck board being a tapered chamfer;

the tapered chamfer terminating in a line;

a second pair of spaced apart runners;

a plurality of spacers affixed to a runner of each pair of the spaced apart runners to leave at least two openings between the said runners;

the outermost edge of each of the second pair of runners having a second plurality of dadoes therein, each of said dadoes in one of said runners being opposite one of said dadoes in the other of said runners; and a second plurality of deck boards stretching between the second pair of runners;

each of the second plurality of deck boards engaging a dado in each of the second pair of runners such that the second plurality of deck boards and the second pair of runners are at the same level to form the bottom of the pallet.

5. A pallet comprising:

a pair of spaced apart runners, each runner having upper and lower edges and opposite ends;

at least the upper edge of each of the runners having a plurality of dadoes therein, each of the dadoes in one of the runners being opposite a dado in the other of the runners;

a plurality of deck boards stretching between the runners, each deck board having a top surface and a bottom surface;

each of the plurality of deck boards engaging a dado in each runner such that the top surfaces of the deck boards and the corresponding upper edges of the runners are at the same level to form the top of the pallet;

the plurality of deck boards including an outermost deck board at each of two opposite ends of the runners, the outermost edge of each outermost deck board being essentially flush with the corresponding ends of the runners so that the ends of the runners do not project beyond the top of the pallet;

at least a portion of the innermost edge of each of the two outermost deck boards being thinner than the full thickness of said deck boards;

the runner adjacent to said thinner portion being undercut beneath the upper edge of the runner complementary to the thinner portion to receive the deck board in intimate contact therewith;

the thinner portion of each deck board having a configuration with drops off from the top surface toward the bottom surface of the deck board in the direction extending away from the outermost edge and toward the innermost edge such that the upper edge of the corresponding runner overlaps essentially the entire thinner portion so as to hold down the corresponding innermost edge against shrinkage and against impact forces upon the outermost edge of the outermost deck board in said direction;

the thinner portion of the deck board being a tapered chamfer;

a second pair of spaced apart runners;

a plurality of spacers affixed to a runner of each pair of the second apart runners to leave a least two openings between the said runners;

the outermost edge of each of the second pair of runners having a second plurality of dadoes therein, each of said dadoes in one of said runners being opposite one of said dadoes in the other of said runners; and a second plurality of deck boards stretching between the second pair of runners;

each of the second plurality of deck boards engaging a dado in each of the second pair of runners such that the second plurality of deck boards and the second pair of runners are at the same level to form the bottom of the pallet.

6. A pallet comprising:

a pair of spaced apart runners, each runner having upper and lower edges and opposite ends;

at least the upper edge of each of the runners having a plurality of dadoes therein, each of the dadoes in one of the runners being opposite a dado in the other of the runners;

a plurality of deck boards stretching between the runners, each deck board having a top surface and a bottom surface;

each of the plurality of deck boards engaging a dado in each runner such that the top surfaces of the deck boards and the corresponding upper edges of the runners are at the same level to form the top of the pallet;

the plurality of deck boards including an outermost deck board at each of two opposite ends of the runners, the outermost edge of each outermost deck board being essentially flush with the corresponding ends of the runners so that the ends of the runners do not project beyond the top of the pallet;

at least a portion of the innermost edge of each of the two outermost deck boards being thinner than the full thickness of said deck boards;

the runner adjacent to said thinner portion being undercut beneath the upper edge of the runner complementary to the thinner portion to receive the deck board in intimate contact therewith;

the thinner portion of each deck board having a configuration which drops off from the top surface toward the bottom surface of the deck board in the direction extending away from the outermost edge and toward the innermost edge such that the upper edge of the corresponding runner overlaps essentially the entire thinner portion so as to hold down the corresponding innermost edge against shrinkage and against impact forces upon the outermost edge of the outermost deck board in said direction;

a second pair of spaced apart runners;

a plurality of spacers affixed to a runner of each pair of the spaced apart runners to leave at least two openings between the said runners;

the outermost edge of each of the second pair of runners having a second plurality of dadoes therein, each of said dadoes in one of said runners being opposite one of said dadoes in the other of said runners; and a second plurality of deck boards stretching between the second pair of runners;

each of the second plurality of deck boards engaging a dado in each of the second pair of runners such that the second plurality of deck boards and the second pair of runners are at the same level to form the bottom of the pallet.

* * * * *